US009077062B2

(12) United States Patent
Brady

(10) Patent No.: US 9,077,062 B2
(45) Date of Patent: Jul. 7, 2015

(54) SYSTEM AND METHOD FOR PROVIDING AN INTERCHANGEABLE DIELECTRIC FILTER WITHIN A WAVEGUIDE

(71) Applicant: Lockheed Martin Corporation, Bethesda, MD (US)

(72) Inventor: Vernon T. Brady, Orlando, FL (US)

(73) Assignee: LOCKHEED MARTIN CORPORATION, Bethesda, MD (US)

( * ) Notice: Subject to any disclaimer, the term of this patent is extended or adjusted under 35 U.S.C. 154(b) by 200 days.

(21) Appl. No.: 13/784,292

(22) Filed: Mar. 4, 2013

(65) Prior Publication Data

US 2013/0229244 A1 Sep. 5, 2013

Related U.S. Application Data

(60) Provisional application No. 61/606,055, filed on Mar. 2, 2012.

(51) Int. Cl.

| | |
|---|---|
| ***H01P 1/20*** | (2006.01) |
| ***H01P 1/205*** | (2006.01) |
| ***H01P 1/208*** | (2006.01) |

(52) U.S. Cl.

CPC ..... *H01P 1/2002* (2013.01); *H01P 1/205* (2013.01); *H01P 1/2084* (2013.01)

(58) Field of Classification Search

CPC .... H01P 1/2084; H01P 1/2088; H01P 1/2002

USPC ..... 333/202, 205, 208

See application file for complete search history.

(56) References Cited

U.S. PATENT DOCUMENTS

| | | | | |
|---|---|---|---|---|
| 6,104,261 | A * | 8/2000 | Sonoda et al. | 333/202 |
| 6,211,752 | B1 | 4/2001 | Gendraud et al. | |
| 6,566,986 | B2 | 5/2003 | Sano et al. | |
| 6,677,837 | B2 * | 1/2004 | Kojima et al. | 333/208 |
| 6,917,266 | B2 | 7/2005 | Mack | |
| 7,009,470 | B2 | 3/2006 | Yatabe et al. | |
| 7,777,598 | B2 | 8/2010 | Salehi et al. | |
| 2008/0129422 | A1 | 6/2008 | Alford et al. | |
| 2009/0231064 | A1 | 9/2009 | Bates et al. | |
| 2012/0293283 | A1 | 11/2012 | Vangala | |

FOREIGN PATENT DOCUMENTS

| | | |
|---|---|---|
| GB | 2367952 | 4/2002 |

* cited by examiner

*Primary Examiner* — John Poos

(74) *Attorney, Agent, or Firm* — Terry M. Sanks, Esq.; Beusse Wolter Sanks & Maire, P.A.

(57) ABSTRACT

A system including a first dielectric filter including a plurality of resonators, a second dielectric filter including a plurality of resonators, and a hollow waveguide configured to receive the first dielectric filter or the second dielectric filter by separating the hollow waveguide into at least a first part and a second part. A width of the plurality of resonators matches a width of a groove within the hollow waveguide to allow insertion of the first dielectric filter or the second dielectric filter into the hollow waveguide where sides of the resonators are in contact with inner sides of the groove of the hollow waveguide. Another embodiment of a system and a method are also disclosed.

19 Claims, 2 Drawing Sheets

SYSTEM AND METHOD FOR PROVIDING AN INTERCHANGEABLE DIELECTRIC FILTER WITHIN A WAVEGUIDE

CROSS-REFERENCE TO RELATED APPLICATIONS

This application claims the benefit of U.S. Provisional Application No. 61/606,055 filed Mar. 2, 2012, and incorporated herein by reference in their entirety.

BACKGROUND

Embodiments relate to a waveguide and, more particularly, to a system and method to provide for interchanging a dielectric filter within a waveguide without further permanent physical alterations being made to the waveguide.

In electromagnetics and communications, the term "waveguide" refers to any linear structure that conveys electromagnetic waves between its endpoints. Waveguides are metallic transmission lines that are used at microwave frequencies, typically to interconnect transmitters and receivers (transceivers) with antennas. Waveguides have a number of advantages over coax, microstrip and stripline. One such advantage is that waveguides are completely shielded, thus an excellent isolation between adjacent signals can be obtained. Another advantage is that waveguides can transmit extremely high peak powers while having very low loss (often almost negligible) at microwave frequencies.

One type of waveguide is a hollow metal pipe used to carry radio waves referred to herein as a hollow waveguide. Other types of waveguides include dielectric waveguides that employ a solid dielectric rod or filter within the hollow opening. Another dielectric waveguide may be optical fibers in which the dielectric guide is designed to work at optical frequencies. Transmission lines such as microstrip, coplanar waveguide, stripline or coaxial may also be considered to be waveguides, however these waveguides have two conductors.

Hollow waveguides are commonly used as a transmission line at microwave frequencies in microwave waveguide hardware, such as for connecting microwave transmitters and receivers to their antennas. A standard hollow waveguide structure is a hollow metal tube or rectangle that distributes electrical inductance at its walls and capacitance in the space between its walls. Waveguide propagation modes depend on the operating wavelength and polarization as well as a shape and size of the hollow waveguide. Hollow waveguides must be one-half wavelength in the dielectric or more in diameter at the frequency one wishes the waveguide to support transmission in order to support one or more transverse wave modes. The shape and dimensions of the hollow waveguides thus determines its frequency, bandwidth, impedance and rejection.

Hollow waveguides are generally made so that the waveguide has a solid outer wall or surface with an opening through a center along its longitudinal axis. When a filter is machined to a part of the waveguide (integral with the waveguide), removing the filter results in damaging, or potentially damaging the waveguide. Microwave waveguide hardware may require a change to a center frequency, bandwidth, impedance or rejection due to changing applications, or a change if the microwave hardware does not work as it was designed. Currently, making such a change requires remachining or other processing to the hollow waveguide itself to provide the desired performance change.

Users of such waveguides and manufacturers would benefit from a system and method changing frequency, bandwidth, impedance or rejection associated with a waveguide filter. Having an insertable or interchangeable dielectric filter does not require making permanent physical alterations to the waveguide.

SUMMARY

Embodiments relate to a system, and method for interchanging a dielectric filter within a waveguide. The system comprises a first dielectric filter including a plurality of resonators and a second dielectric filter including a plurality of resonators. The system also comprises a hollow waveguide configured to receive the first dielectric filter or the second dielectric filter by separating the hollow waveguide into at least a first part and a second part. A width of the plurality of resonators matches a width of a groove within the hollow waveguide to allow insertion of the first dielectric filter or the second dielectric filter into the hollow waveguide where sides of the resonators are in contact with inner sides of the groove of the hollow waveguide.

Another embodiment of a system comprises a hollow waveguide configured to receive a dielectric filter within a cavity, and a first dielectric filter configured to fit within the cavity to provide a first center frequency, a first bandwidth, a first impedance or a first rejection characteristic for the hollow waveguide. The hollow waveguide is configured so that that the first dielectric filter may be replaced with a second dielectric filter to provide a second center frequency, a second bandwidth, a second impedance or a second rejection characteristic for the hollow waveguide.

The method comprises configuring a hollow waveguide to receive a dielectric filter within a cavity with a machine. The method also comprises providing at least a first dielectric filter configured to fit within the cavity to provide a first center frequency, a first bandwidth, a first impedance or a first rejection characteristic for the hollow waveguide and a second dielectric filter configured to fit within the cavity to provide a second center frequency, a second bandwidth, a second impedance or a second rejection characteristic for the hollow waveguide, the first dielectric filter and the second dielectric filter are designed with a software simulation package. The method also comprises replacing the first dielectric filter with the second dielectric filter without making a permanent change to a dimension of the cavity of the waveguide to accommodate the second dielectric filter.

BRIEF DESCRIPTION OF THE DRAWINGS

A more particular description briefly stated above will be rendered by reference to specific embodiments thereof that are illustrated in the appended drawings. Understanding that these drawings depict only typical embodiments and are not therefore to be considered to be limiting of its scope, the embodiments will be described and explained with additional specificity and detail through the use of the accompanying drawings in which.

DETAILED DESCRIPTION

Figure 2:
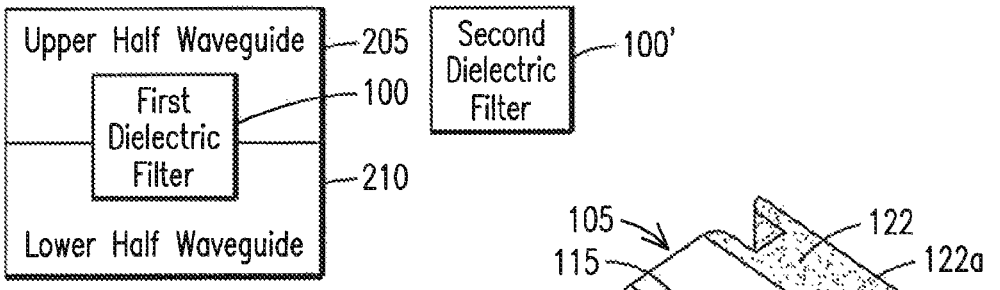
FIG. 2 shows a block diagram of an embodiment of a system.

Embodiments are described with reference to the attached figures, wherein like reference numerals, are used throughout the figures to designate similar or equivalent elements. The figures are not drawn to scale and they are provided merely to illustrate aspects disclosed herein. Several disclosed aspects are described below with reference to example applications for illustration. It should be understood that numerous specific details, relationships, and methods are set forth to provide a full understanding of the embodiments disclosed herein. One having ordinary skill in the relevant art, however, will readily recognize that the disclosed embodiments can be practiced without one or more of the specific details or with other methods. In other instances, well-known structures or operations are not shown in detail to avoid obscuring aspects disclosed herein. Disclosed embodiments are not limited by the illustrated ordering of acts or events, as some acts may occur in different orders and/or concurrently with other acts or events. Furthermore, not all illustrated acts or events are required to implement a methodology in accordance with the embodiments.

Notwithstanding that the numerical ranges and parameters setting forth the broad scope are approximations, the numerical values set forth in specific non-limiting examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein. For example, a range of "less than 10" can include any and all sub-ranges between (and including) the minimum value of zero and the maximum value of 10, that is, any and all sub-ranges having a minimum value of equal to or greater than zero and a maximum value of equal to or less than 10, e.g., 1 to 6.

Figure 1:
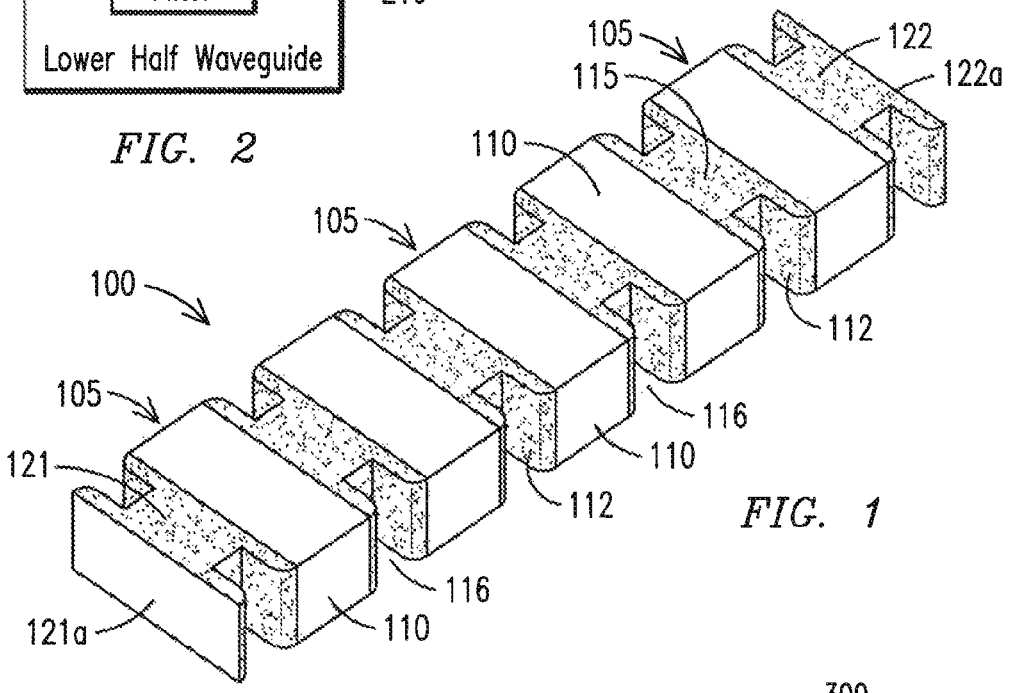
FIG. 1 shows an embodiment of a dielectric filter.

FIG. 1 shows an embodiment of a dielectric filter 100. Though a specific embodiment of the dielectric filter 100 is disclosed herein, other embodiments are also possible. Therefore, the disclosed dielectric embodiment should not be considered limiting. The filter 100 includes a dielectric slab (or block) 110 shaped to define a plurality of dielectric resonators 105 shown as rectangular resonators that are coupled to one another by interior irises such as iris 115. The dielectric filter 100 may comprise a first end iris 121 and a second end iris 122. The irises 115, 121, and 122 may be defined by slots 116 (iris waists). The dielectric filter 100 may include an electrically conductive coating 112 referred to herein as a metal coating 112. The first end iris 121 has an uncoated (i.e., not metal coated; exposed) dielectric face 121*a* and the second end iris 122 has an uncoated (not metal coated; exposed) dielectric face 122*a*. The first end iris 121 and second end iris 122 may be configured not to form resonators.

Generally, the dielectric filters are metal coated except on the uncoated dielectric faces 121*a*, 122*a*. However, the dielectric filter 100 shown in FIG. 1 lacks metal on its sides and top which when placed in an exact (or near exact) fitting waveguide structure can utilize the metal of the waveguide, so that a metal coating is not required. The irises (waists) must have metallization if the waveguide does not have protrusions from the walls to provide a conductor wall at the irises.

The width dimension of the slots 116, which extends in the longitudinal direction of the dielectric slab 110, and the depth of the slots 116, which extends in the transverse or width direction of the dielectric slab 110, control the coupling between the resonators 105 and thus the bandwidth of the dielectric filter 100. The lengths of the resonators 105 primarily determine the frequency response of the dielectric filter 100.

The first end iris 121 and the second end iris 122 are used as inputs/outputs for the dielectric filter 100. The first end iris 121 and the second end iris 122 can be seen to be exclusive of any coupling structure, such as conventional coaxial connections (e.g., inline, transverse, with or without probes into the resonator, cavity or dielectric).

The dielectric slab 110 may comprise a single dielectric piece which can be molded or machined from plastic or similar dielectric material. The width of the resonators and height of the resonators 105 may be the same dimensions as that of the hollow waveguide.

FIG. 2 shows a block diagram of an embodiment of a system. The (first) dielectric filter 100 is disclosed. A waveguide 200 is disclosed having an upper half 205 and a lower half 210. The two halves may or may not have equivalent dimensions. As a non-limiting example, the lower half 210 may have a greater volume into which the dielectric filter may fit and the upper half 205 may appear to act more as a top or cover. In another non-limiting example, the waveguide 200 may comprise more than two separatable parts. Thus, though only two parts are disclosed herein, having only two parts is not meant to be limiting. In another non-limiting example, the waveguide has an access panel or port through which the first dielectric filter 100 may be removed and another (second dielectric filter 100') inserted and placed within the waveguide 200 as disclosed herein. In another non-limiting example, the waveguide is a solid piece of material with no access ports or panels specifically designed to insert the dielectric filter 100 or being able to be split or separated into parts. In this embodiment, the dielectric 100 may be placed or inserted through a hollow opening in an end of the waveguide 200.

Figure 3:
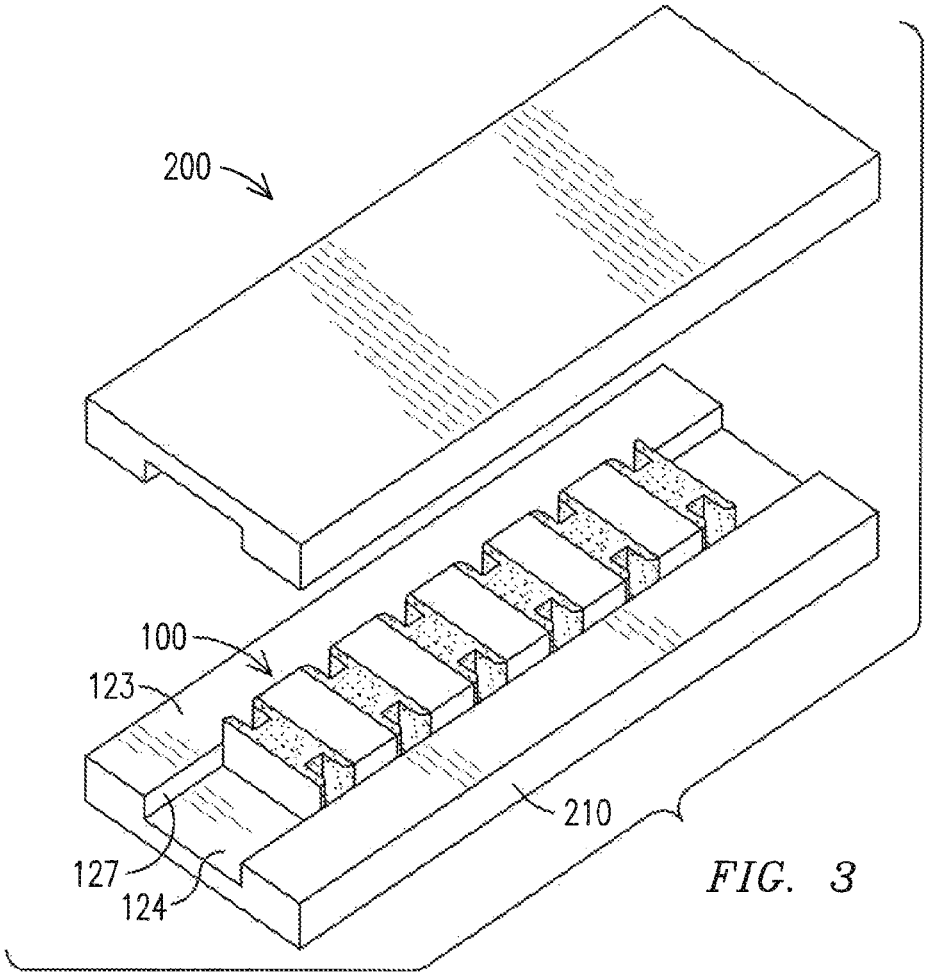
FIG. 3 shows the dielectric filter resting in a lower half of a hollow waveguide and with an upper half also illustrated.

FIG. 3 shows the dielectric filter resting in a lower half of a hollow waveguide and with an upper half also illustrated. In an embodiment, only a lower half 210 is used. The dielectric filter 100 may be placed in a straight or standard section of waveguide hardware. In this arrangement, the waveguide filter 200 is part of the transmission line itself. In an embodiment, the upper half 205 is provided to enclose the dielectric filter 100. The upper half 205 may be a piece of metal matching the size and shape of lower half 210 of the hollow waveguide.

The dielectric filters may be configured to fit (inserted) into the open area 124 (groove, slot, opening, cavity, channel, etc.) of either the upper half 205 or lower half 210 of the hollow waveguide 200, so that when the upper half 205 and lower half 210 are connected the metal of the hollow waveguide 200 provides metal on or proximate to the top wall, side wall and bottom wall of the resonators 105. More specifically, a width of the plurality of resonators are configured to match a width of the slot 124 within the hollow waveguide to allow insertion of the dielectric filter into the hollow waveguide where sides of the resonators are in contact with inner sides of the groove of the hollow waveguide. In this application, the in-coupling and the out-coupling of the waveguide to the dielectric filter 100 is provided by simply having the dielectric filter 100 positioned within the waveguide. Notwithstanding this application, the coupling into the filter is always by way of the waveguide, even if the waveguide is part of a coax to waveguide adapter.

The length of the first end iris 121 and the second end iris 122 may provide matching elements as they allow a degree of reflection reduction, or coupling energy into and energy out from the dielectric filter 100. Although a simple flat surface for the uncoated dielectric faces 121*a*, 122*a* has been found to provide a fairly good match to a hollow waveguide (minimum microwave reflection), the match may be improved, such as by forming a protrusion (not illustrated) on the first end iris 121 and second end iris 122 that would extend into the waveguide.

In an embodiment, securing element may be provided to hold the dielectric filter in place once positioned within the waveguide 200. A protrusion (not shown) may be provided extending from a side wall 127 of the slot 124. The waveguide wall protrusion (not shown) would fit into one of the iris waists 116 to hold the dielectric filter securely in place. In another embodiment, a transition to coax adapter (not shown) may be provided at an end of the waveguide 200 to hold the dielectric filter 100 in place once the dielectric filter 100 is inserted into the waveguide 200.

In a non-limiting example, matching protrusions that improve the return loss can fit into the existing waveguide and need no other machining. They can simply "stick into" or protrude into the normal waveguide at the ends of the dielectric filter 100. They thus do not require any changes to the waveguide walls. The feature that secures the dielectric filter into the waveguide, for example, may use a vertical ridge 123 that would be on the sidewall (e.g., 0.140 inch) and fit into the area of no dielectric that forms the iris. Multiple vertical ridges 123 may be provided to form at least one slot 124.

If a change in center frequency, bandwidth impedance or rejection of the waveguide filter 200 is desired, the disclosed dielectric filter 100 may be removed from the hollow waveguide and replaced with another disclosed dielectric filter having a different design (e.g., length, resonator size(s), etc.), to provide the waveguide filter 200 a different center frequency, bandwidth, impedance and/or rejection characteristic. Thus, only the dielectric filter element needs to be replaced. Machining of the hollow waveguide to provide a different center frequency, bandwidth impedance and/or rejection characteristic is no longer needed. Significantly, disclosed dielectric filters may be removed and replaced in the actual waveguide to change frequency response. Not having transitions from one form of transmission line to another means disclosed arrangements will be lower loss, providing improved performance as well as the ability to change the frequency response of an existing piece of microwave hardware inexpensively.

Additionally, the hollow waveguide can be in the form of a split block, or the like, with the waveguide machined into the surface. When the dielectric filter is inserted into the waveguide and the top and bottom halves 205, 210 assembled, the waveguide would then have the filter response of the dielectric filter 100.

The cost of disclosed waveguide filters is small compared to conventional machining of the metal waveguide. The dielectric filter elements may be pretested so that defects in machining will only affect the dielectric filter that may be discarded at little cost.

Dielectric resonator designs can be carried out using software simulation packages that generate designs based on specifying parameters such as response shape, dielectric constant, and return loss. For example, disclosed designs may be carried out using the software package WASPNET (WASPNET™, Microwave Innovation Group ("MIG")), which is a hybrid electromagnetic simulator based on several analysis and optimization methods including Mode-Matching (MM), Finite Elements (FE), Method of Moments (MoM) and Finite Differences (FD). Other software packages that may be used to designed dielectric filters include Agilent FEM ELEMENT™ (Agilent Technologies, Inc., Santa Clara, Calif.), Ansoft HFSS™ (Ansoft Corporation, Pittsburgh, Pa.).

Figure 4:
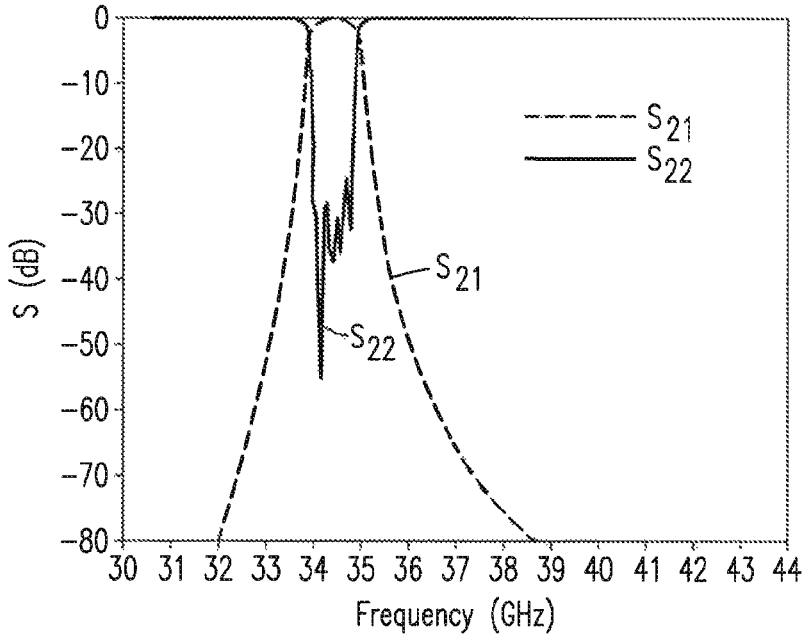
FIG. 4 shows simulated frequency performance in terms of scattering parameters for a disclosed dielectric filter.

FIG. 4 shows simulated frequency performance in terms of scattering parameters (S21 and S22) for a disclosed dielectric filter 100 between about 30 GHz and 44 GHz. FIG. 4 is a non-limiting example of the disclosed embodiments with actual ranges as tested by the Inventor. The dielectric filter dimensions were a width of 0.280 inches, a height of 0.140 inches, and overall length of 1.213 inches, a resonator length of 0.127 inches, an iris widths of 0.095, 0.117, and 0.148 inches, an iris length of 0.040 inches, an iris to resonator and unmetallized face length of 0.028 inches. The height and width of the filter 100 were selected to match the waveguide hardware. The response in FIG. 4 shows low loss, High-Q, as well as good matching.

Figure 5:
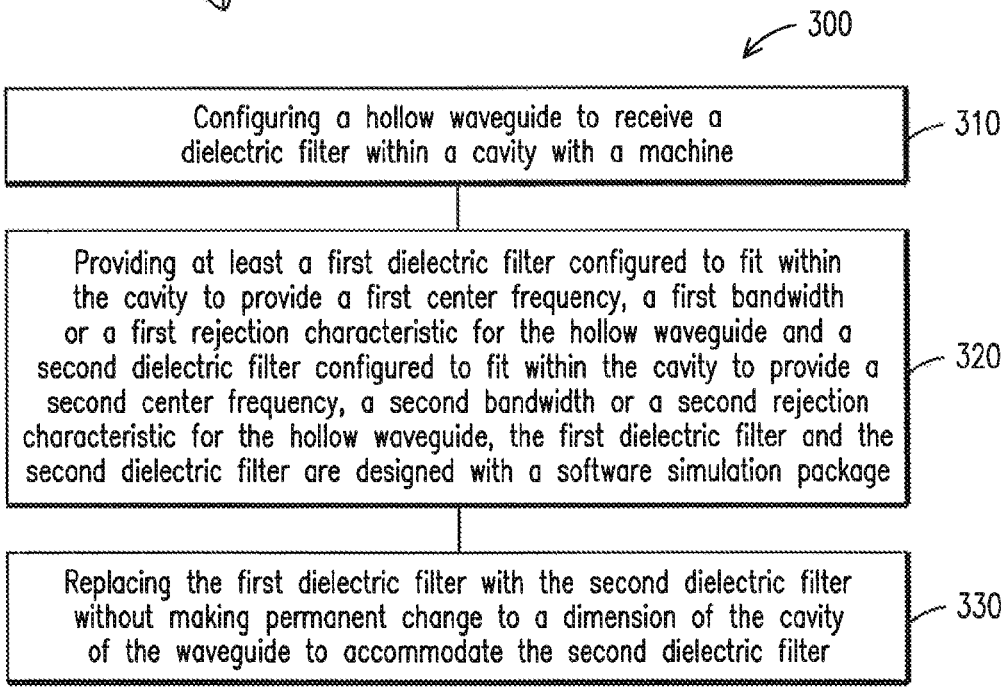
FIG. 5 shows a flowchart illustrating a method of an embodiment.

FIG. 5 shows a flowchart illustrating a method of an embodiment. The method 300 comprises configuring a hollow waveguide to receive (or accept) a dielectric filter within a cavity with a machine, at 310. The method further comprises providing at least a first dielectric filter configured to fit within the cavity to provide a first center frequency, a first bandwidth, a first impedance or a first rejection characteristic for the hollow waveguide and a second dielectric filter configured to fit within the cavity to provide a second center frequency, a second bandwidth, a second impedance or a second rejection characteristic for the hollow waveguide, the first dielectric filter and the second dielectric filter are designed with a software simulation package, at 320. The method further comprises replacing the first dielectric filter with the second dielectric filter without making a permanent change to a dimension of the cavity of the waveguide (such as physically altering) to accommodate the second dielectric filter.

Though the method uses the term "configured," and "configuring" these terms may be considered as meaning machining. More specifically, configuring or configured should be considered as utilizing an appropriate machine to create the components to have the specific characteristics claims. For example, "providing at least a first dielectric filter configured to fit within the cavity" may be read to mean providing at least a first dielectric filter machined with a tool or machine designed to form a dielectric filter so that the first dielectric filter fits within the cavity.

Replacing the first dielectric filter may further comprise separating the hollow waveguide into at least a first part and a second part to receive the first dielectric filter or the second dielectric filter. Providing at least a first dielectric filter and a second dielectric filter may further comprise forming the first dielectric filter or the second dielectric filter to comprise a plurality of resonators. Providing at least a first dielectric filter and a second dielectric filter may further comprise configuring the first dielectric filter or the second dielectric filter from a dielectric slab into a shape to define a plurality of dielectric resonators that are coupled by irises defined by slots, including a first end iris and a second end iris.

While various disclosed embodiments have been described above, it should be understood that they have been presented by way of example only, and not as a limitation. Numerous changes to the disclosed embodiments can be made in accordance with the Disclosure herein without departing from the spirit or scope of this Disclosure. Thus, the breadth and scope of this Disclosure should not be limited by any of the above-described embodiments. Rather, the scope of this Disclosure should be defined in accordance with the following claims and their equivalents.

Although disclosed embodiments have been illustrated and described with respect to one or more implementations, equivalent alterations and modifications will occur to others skilled in the art upon the reading and understanding of this specification and the annexed drawings. While a particular feature may have been disclosed with respect to only one of several implementations, such a feature may be combined with one or more other features of the other implementations as may be desired and advantageous for any given or particular application.

The terminology used herein is for the purpose of describing particular embodiments only and is not intended to be limiting to this Disclosure. As used herein, the singular forms "a," "an," and "the" are intended to include the plural forms as well, unless the context clearly indicates otherwise. Furthermore, to the extent that the terms "including," "includes," "having," "has," "with," or variants thereof are used in either the detailed description and/or the claims, such terms are intended to be inclusive in a manner similar to the term "comprising."

Unless otherwise defined, all terms (including technical and scientific terms) used herein have the same meaning as commonly understood by one of ordinary skill in the art to which the embodiments belong. It will be further understood that terms, such as those defined in commonly-used dictionaries, should be interpreted as having a meaning that is consistent with their meaning in the context of the relevant art and will not be interpreted in an idealized or overly formal sense unless expressly so defined herein.

Thus, while embodiments have been described with reference to various embodiments, it will be understood by those skilled in the art that various changes, omissions and/or additions may be made and equivalents may be substituted for elements thereof without departing from the spirit and scope of the embodiments. In addition, many modifications may be made to adapt a particular situation or material to the teachings of the embodiments without departing from the scope thereof. Therefore, it is intended that the embodiments not be limited to the particular embodiment disclosed as the best mode contemplated, but that all embodiments falling within the scope of the appended claims are considered. Moreover, unless specifically stated, any use of the terms first, second, etc., does not denote any order or importance, but rather the terms first, second, etc., are used to distinguish one element from another.

The invention claimed is:

1. A system comprising:

a dielectric filter including a single dielectric slab shaped to define a plurality of dielectric resonators separated and coupled by irises defined by slots formed in the dielectric slab, including a first end iris and a second end iris, the irises are electrically conductive coated except an end wall face of the first end iris and an end wall face of the second end iris and each resonator having a top wall, side walls and a bottom wall;

and a hollow waveguide having a groove configured to receive the dielectric filter and provide metal on or proximate to the top wall, the side walls and the bottom wall of the plurality of dielectric resonators, the hollow waveguide configured to provide access to the groove to interchange the dielectric filter;

wherein a width of the plurality of resonators fits a width of the groove within the hollow waveguide to allow insertion and removal of the dielectric filter into and out of the hollow waveguide where the top, side and bottom walls of the resonators are in contact with inner sides of the groove of the hollow waveguide.

2. The system according to claim 1, wherein the hollow waveguide is not permanently physically altered to accept the dielectric filter and includes a first art and a second part where the first part and the second part are separable to provide access to the groove for insertion and removal of the dielectric filter.

3. The system according to claim 1, wherein a length of the first end iris and the second end iris provides matching elements to couple energy into and energy out from the dielectric filter and wherein coupling into the dielectric filter is by the hollow waveguide.

4. The system according to claim 3, wherein the end wall face of the first end iris is a first exposed dielectric face and the end wall face of the second end iris is a second exposed dielectric face, the first exposed dielectric face configured to provide an input for coupling energy into the dielectric filter and the second exposed dielectric face configured to provide an output for coupling energy out from the dielectric filter.

5. The system according to claim 4, wherein the first and the second end irises are exclusive of any coupling structure.

6. A system comprising:

a hollow waveguide having a cavity and configured to interchange a dielectric filter within the cavity; and each dielectric filter configured to fit within the cavity to provide a center frequency, a bandwidth, an impedance or a rejection characteristic for the hollow waveguide, said each dielectric filter comprises a single dielectric slab shaped to define a plurality of dielectric resonators separated and coupled by irises defined by slots formed in the dielectric slab, including a first end iris and a second end iris, the irises are electrically conductive coated except an end wall face of the first end iris and an end wall face of the second end iris and each resonator having a top wall, side walls and, a bottom wall;

wherein the system is configured to change the center frequency, the bandwidth, the impedance, or the rejection characteristic for the hollow waveguide by interchanging the dielectric filter from within the cavity with another dielectric filter which fits the cavity.

7. The system according to claim 6, wherein the cavity of the hollow waveguide is not physically altered to accept said each dielectric filter.

8. The system according to claim 6, wherein the hollow waveguide is configured to separate into at least a first part and a second part to receive said each dielectric filter.

9. The system according to claim 6, wherein a width of said each dielectric filter fits a width of the cavity within the hollow waveguide to allow insertion into the hollow waveguide where the top, side and bottom walls are in contact with inner sides of the cavity of the hollow waveguide.

10. The system according to claim 6, wherein the cavity provides metal on or proximate to the top, side and bottom walls of the plurality of dielectric resonators.

11. The system according to claim 6, wherein the hollow waveguide includes an upper half and a lower half where the upper half and the lower half are separable to provide access to the cavity for replacement of the dielectric filter from within the cavity.

12. The system according to claim 11, wherein the end wall face of the first end iris is a first exposed dielectric face and the end wall face of the second end iris is a second exposed dielectric face, the first exposed dielectric face configured to provide an input for coupling energy into the dielectric filter and the second exposed dielectric face configured to provide an output for coupling energy out from the dielectric filter.

13. The system according to claim 6, wherein the first and second end irises are exclusive of any coupling structure.

14. The system according to claim 6, wherein the first end iris and the second end iris have a common height and width with respect to the plurality dielectric resonators.

15. The system according to claim 6, wherein the hollow waveguide comprises a split block waveguide or an open waveguide wherein the cavity in the open waveguide is a channel.

16. A method comprising:

configuring a hollow waveguide to receive a dielectric filter within a cavity with a machine;

providing a first dielectric filter configured to fit within the cavity to provide a first center frequency, a first bandwidth, a first impedance or a first rejection characteristic for the hollow waveguide and a second dielectric filter configured to fit within the cavity to provide a second center frequency, a second bandwidth, a second impedance or a second rejection characteristic for the hollow waveguide, the first dielectric filter and the second dielectric filter are designed with a software simulation package; and replacing the first dielectric filter with the second dielectric filter without making a permanent change to a dimension of the cavity of the waveguide to accommodate the second dielectric filter wherein each of the first dielectric filter and the second dielectric filter comprises a single dielectric slab shaped to define a plurality of dielectric resonators separated and coupled by irises defined by slots formed in the dielectric slab, including a first end iris and a second end iris, the irises are electrically conductive coated except and wall face of the first end iris and an end wall face of the second end iris and each resonator having a top wall, side walls and a bottom wall.

17. The method according to claim 16, wherein replacing the first dielectric filter further comprises separating the hollow waveguide into at least a first part and a second part to replace the first dielectric filter with the second dielectric filter.

18. The method according to claim 16, wherein the first dielectric filter and the second dielectric filter have different lengths.

19. The method according to claim 16, wherein the first dielectric filter and the second dielectric filter have a different number of dielectric resonators.

* * * * *

UNITED STATES PATENT AND TRADEMARK OFFICE

CERTIFICATE OF CORRECTION

PATENT NO. : 9,077,062 B2
APPLICATION NO. : 13/784292
DATED : July 7, 2015
INVENTOR(S) : Vernon T. Brady It is certified that error appears in the above-identified patent and that said Letters Patent is hereby corrected as shown below:

In the Claims
Column 7, claim 2, line 67, delete “art” and insert --part--.
Column 8, claim 6, line 31, delete “,” second occurrence.
Column 10, claim 16, line 6, delete “and” and insert --an end--.

Signed and Sealed this
Twenty-fourth Day of November, 2015

Michelle K. Lee

Michelle K. Lee
*Director of the United States Patent and Trademark Office*